US005351948A

United States Patent [19]

Thomas

[11] Patent Number: 5,351,948

[45] Date of Patent: Oct. 4, 1994

[54] PORTABLE BALL RECEIVER WITH INTEGRATED BALL SUPPORTING PLATFORM

[76] Inventor: Roy J. Thomas, 12823 NE. 107th Pl., Kirkland, Wash. 98033

[21] Appl. No.: 202,383

[22] Filed: Feb. 28, 1994

[51] Int. Cl.[5] ..... A63B 69/00

[52] U.S. Cl. ..... 273/26 A; 273/400

[58] Field of Search ..... 273/26 A, 25, 181 F, 273/398, 400

[56] References Cited

U.S. PATENT DOCUMENTS

| | | | |
|---|---|---|---|
| 2,126,102 | 8/1938 | Fowler | 273/26 A |
| 2,944,816 | 7/1960 | Dixon | 273/26 A |
| 3,386,733 | 6/1968 | Russo et al. | 273/26 R |
| 3,583,703 | 6/1971 | Brown et al. | 273/26 A |
| 3,711,092 | 1/1973 | Hogue | 273/26 A |
| 4,127,267 | 11/1978 | Bay et al. | 273/26 A |
| 4,210,326 | 7/1980 | Booth | 273/26 A |
| 4,533,138 | 8/1985 | Rodriguez et al. | 273/26 R |
| 4,905,996 | 3/1990 | Tallent et al. | 273/26 A |
| 5,083,774 | 1/1992 | Yalvac | 273/26 A |
| 5,106,085 | 4/1992 | Lewy | 273/26 R |
| 5,242,160 | 9/1993 | Girard et al. | 273/26 A |

*Primary Examiner*—William H. Grieb

[57] ABSTRACT

A portable ball receiving device with attachments for hitting and throwing. A lightweight frame with a large aperture for receiving a multitude of sports related balls. The main frame members are coupled at midpoint to allow for easy separation or connection. The rear base folds onto the same plane with the vertical and oblique members when in a portable configuration. It includes a receiving net to catch and contain balls which are hit, thrown, or kicked into the frame aperture. Attachments include a vertically adjustable batting tee and a strike zone that hooks to the corners for easy use.

2 Claims, 3 Drawing Sheets

PORTABLE BALL RECEIVER WITH INTEGRATED BALL SUPPORTING PLATFORM

This invention relates to an apparatus which provides a receiver/stop for batted, kicked, thrown, or hit balls, more specifically, to an easily movable and portable apparatus which includes a target, a large catch net, and an integrated platform ball holder.

BACKGROUND—DESCRIPTION OF PRIOR ART

The value our society has placed upon success in athletics has led to the development of many sports training tools. The desire for individualized, portable home training devices has inspired several inventions whose costs and ineffectiveness have caused a proliferation of backyard experimental devices to appear. Of the current inventions, some are narrowly focussed on one specific sports skill. Examples of these devices are Russo, et al, Batting Practice Device, U.S. Pat. No. 3,386,733, which is aimed at increasing a batters strengths and skills; Bay and Del Marco, U.S. Pat. No. 4,127,267, Collapsible Frame With Hanging Net Ball Arresting Apparatus, a ball stopping device which has a taut net using frame movement to absorb projectile energy; and Booth and Ingle, U.S. Pat. No. 4,210,326, which represents a movable target and a net stop for baseball pitching practice.

Major limitations of these devices and others is their focus on one specific sport skill, which is evidenced by the aperture size and function of their catch nets. They also do not have any integrally related attachments that would enhance their devices' effectiveness and reduce the users' costs. Of the above devices that profess portability, their need for wheels indicates a major limitation upon their ease of handling. These problems have been partially solved by Rodriguez, et al, U.S. Pat No. 4,533,138, Multiple Sport Training Device, which focuses on several different sports skills. But it still does not meet the simplistic needs of the individual consumer. This '138 patent is to a small degree multiple sport capable, yet because of a preponderance of parts and adjustments it does not adequately address the needs of any one sport. This design, and others in the field, are portable only in the respect that they can be moved. The necessity for wheels to render a device mobile speaks of an awkward weight that would cause handling problems for young adults. The costs associated with patent '138 and its multitude of attachments points it away from the individual home environment and toward institutional use. The small aperture opening for its receiving net limits the success of the device to receive a ball.

OBJECTS AND ADVANTAGES

There is a real need for a ball receiver that is truly portable, multiple sport functional indoors or out, and economical. Therefore, several objects and advantages of the invention are:

(a) to provide a ball receiving device which allows in seconds a quick and easy assembly or breakdown;

(b) to provide a ball receiving device which can be easily transported from home to vehicle to practice field;

(c) to provide a ball receiving device which can be stored in a small, narrow area;

(d) to provide a ball receiving device which can be used for teaching different skills;

(e) to provide a ball receiving device which can be utilized indoors or out;

(f) to provide a ball receiving device which is durable, and proven to be economical at less than half the cost of similar devices.

(g) to provide a ball receiving device which allows easy adjustments of an attachable ball support platform;

(h) to provide a ball receiving device whose receiving net design function is superior to prior art in receiving and retaining ball projectiles.

(i) to provide a ball receiving device which when compared to prior art is truly portable for young athletes.

Further objects and advantages will become apparent from a consideration of the following description and drawings.

DRAWING FIGURES

In the drawings, closely related figures have the same number but different alphabetic suffixes.

REFERENCE NUMERALS IN DRAWINGS

Figure 1:
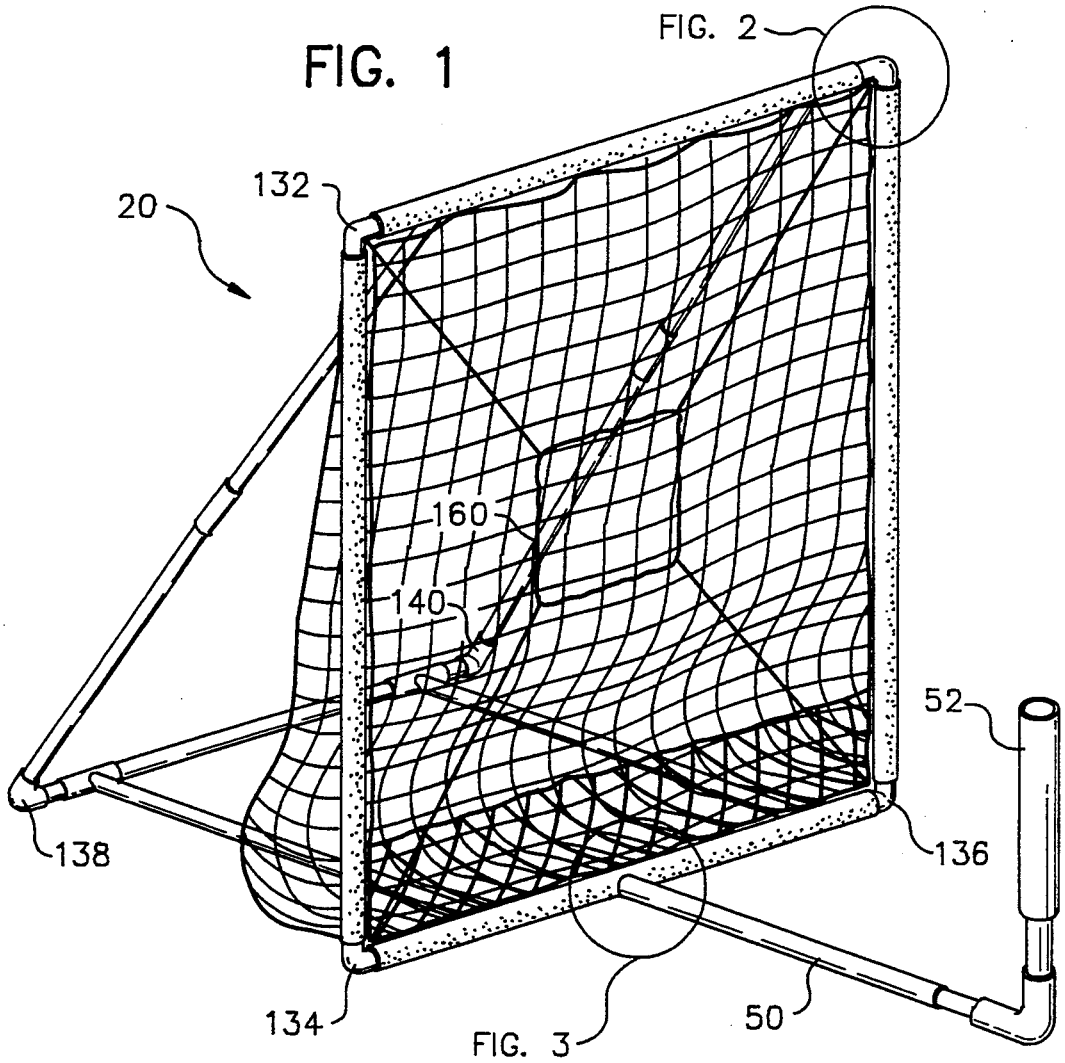
FIG. 1 shows a perspective view of the apparatus of the present invention.

20 support frame
30 receiving net
40 upper horizontal protective pad
42 side vertical protective pad
44 side vertical protective pad
46 base horizontal protective pad
50 forward facing tube extension
52 rubber attachment (platform)
54 machined coupler
56 inner tube for platform slide
58 1" ninety degree elbow
59 machined coupler
60 machined tee
62 machined tee
64 machined tee
66 machined tee
68 machined tee
70 machined tee
72 machined tee
74 through-hole in tee 72
76 through-hole in tube 50
78 pin
80 coupler

82 coupler
84 coupler
86 coupler
90 bottom front net flap
92 flap rope
93 net edge rope
94*a* through-hole for net flap rope
94 *b* through-hole for net flap rope
100 upper horizontal tube
102 upper vertical tube
104 lower vertical tube
106 base horizontal tube
108 rear base horizontal tube
110 lower oblique brace
112 upper oblique brace
114 lower oblique brace
116 upper oblique brace
118 lower vertical tube
120 upper vertical tube
122 rearward facing base tube
124 rearward facing base tube
130 elbow
132 elbow
134 elbow
136 elbow
138 elbow
140 elbow
150 *a–j* cable ties
160 strike zone rope target outline
162 *a, b, c, d,* string
164 *a, b, c, d,* hooks
166 *a, b, c, d, c* shaped connectors
168 *a, b, c, d, c* shaped connectors

DESCRIPTION—FIGS. 1, 2, 5, 6, 7, 8, 10, 11

The construction of the present embodiment uses well known and widely available means for connecting and fastening. Standard couplings, elbows, and other polyvinyl chloride pipe fittings comprise all components with the exception of certain fittings which must be machined to accomplish designed functions. These exceptions, and others, are explained in the detailed descriptions.

Figure 4:
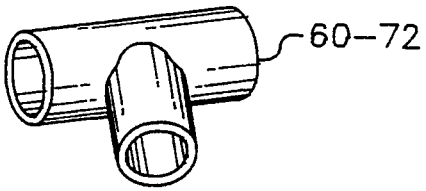
FIG. 4 shows machined tees that rotate freely on the horizontal tubes.
Figure 5:
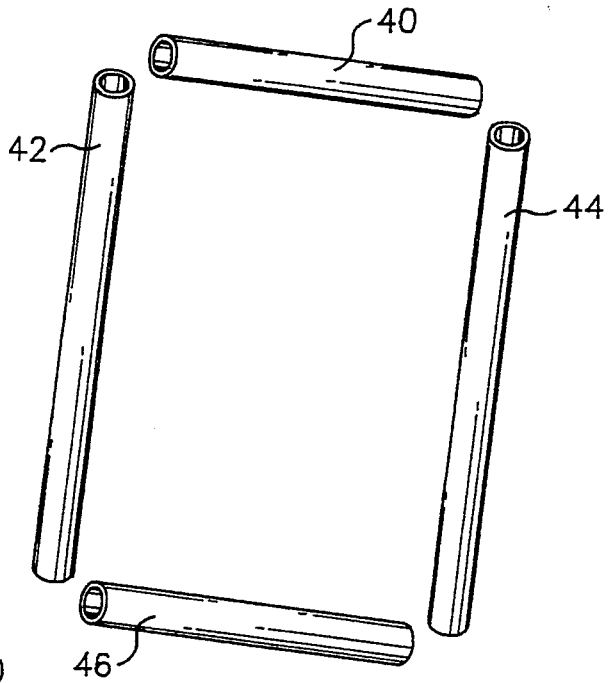
FIG. 5 shows protective padding that are affixed to frontal frame horizontals and verticals.
Figure 10:
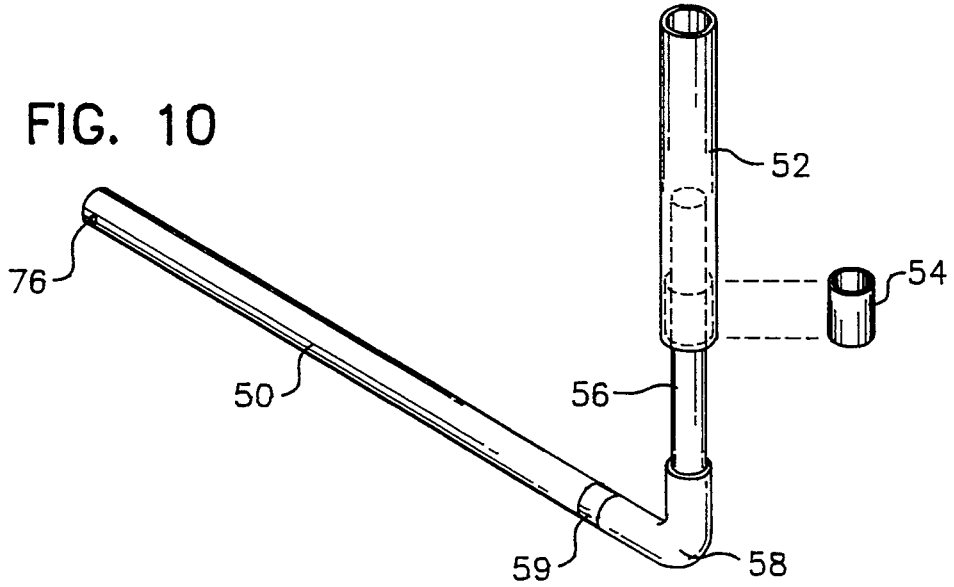
FIG. 10 shows a breakdown of the adjustable batting tee assembly.

FIG. 1 shows a frame 20, which is constructed of well known and widely available means for connecting and fastening, with the exceptions that follow: FIG. 4 shows a well known tee (representing tees 60 to 72) which is machined to slide over and rotate upon a base horizontal tube 106, a rear base horizontal tube 108, and a upper horizontal tube 100 for ease of portability; FIG. 10 shows well known machined coupler 54, which slides over inner tube for platform slide 56. FIG. 10 also shows a rubber attachment 52, which by friction retains the coupler 54 within its interior and near the bottom edge of said rubber attachment. A machined coupler 59 connects a forward facing tube extension 50 to a 1" ninety degree elbow 58.

Figure 2:
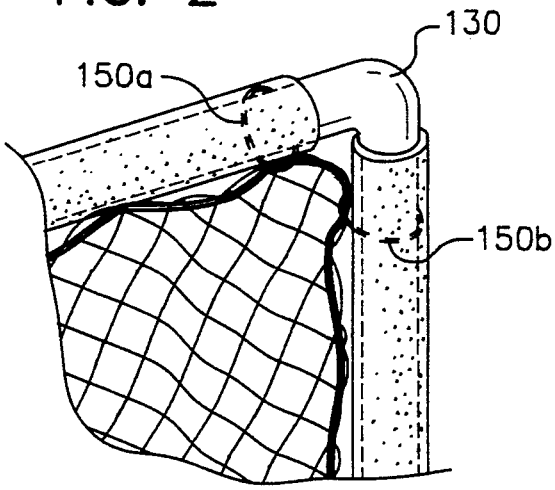
FIG. 2 shows an enlarged fragmentary view illustrating the securing of the net to the frame.
Figure 3:
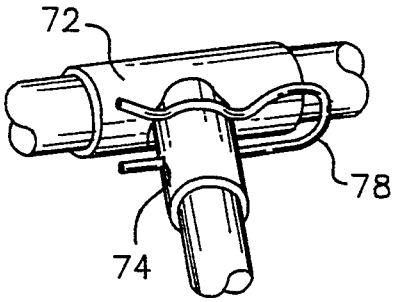
FIG. 3 shows the anterior view of the frame base illustrating the connective tee and pin for the batting tee that extends perpendicular and forward from the base tube.
Figure 7:
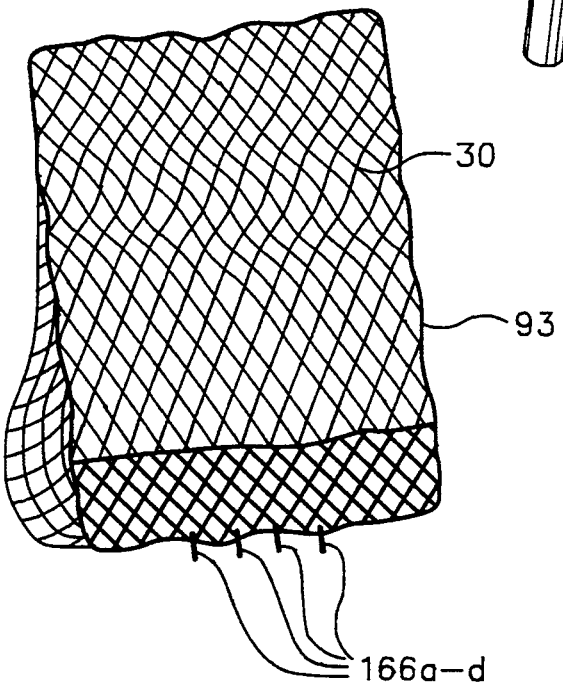
FIG. 7 shows receiver net, edge rope, net flap, and net flap rope.

FIG. 7 shows a receiving net 30, a net edge rope 93 and its weaving design around the net edge, and a flap rope 92 and its weaving design through the top edge of a bottom front net flap 90. FIG. 2 shows a magnified view the net 30 secured to a upper horizontal tube 100 by means of cable tie 150*a*, attached around the rope 93 and through the net 30, and said base horizontal tube 106 by means of cable tie 150*b* around the edge rope 93 and through the net 30.

FIG. 2 shows securing cable ties technique, and said net edge rope 93 weave along the verticals that allows upward net mobility. The rope 93 encircles entire said receiving net 30, woven through the net 30 loops with its ends (rope 93) coupled together with "c" connectors 168*a, b, c ,d.*

Figure 8:
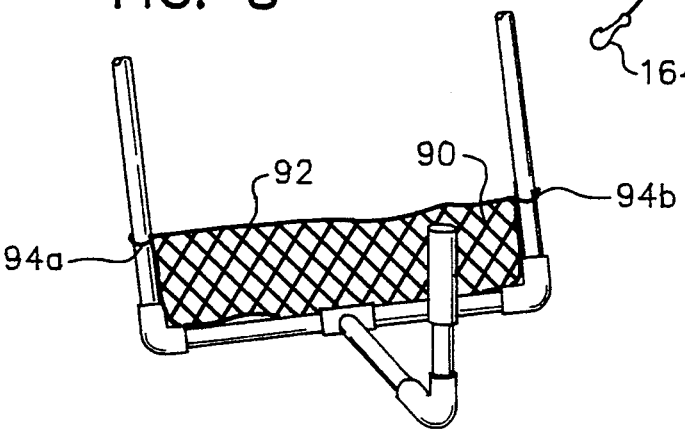
FIG. 8 shows bottom flap of net that functions as a ball retainer.

FIG. 8 shows a bottom front net flap 90, a integral part of the net 30 sharing securing cable ties 150*e, f, g, h,* to frame 20, its upper edge secured with a flap rope 92 woven through net flap 90. The flap rope 92 is secured to lower vertical tubes 118 and 104 by through holes 94*a,* and *b* respectively.

Figure 6:
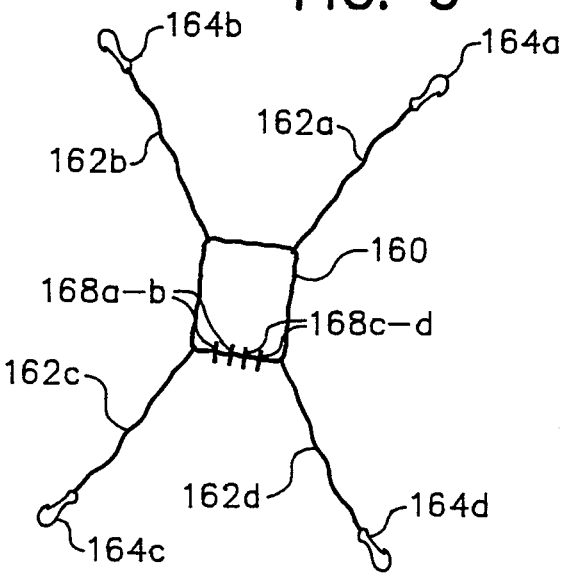
FIG. 6 shows strike zone attachment.

The net 30 can receive a sports training attachment shown in FIG. 6. A pitching training attachment includes a strike zone rope target outline 160 whose ends have been connected by "c" connectors 166*a, b, c, d,* to form a completed loop. Strings 162*a, b, c, d,* are attached to the target rope 160 by a knotted means and to hooks 164*a, b, c, d,* by knotted means. Hooks 164*a–d* attach to the net 30 corners. A upper horizontal protective pad 40 connects to said upper horizontal tube 100. A side vertical protective pad 42 connects to a upper vertical tube 120 and to the vertical tube 118. A side vertical protective pad 44 connects to a upper vertical tube 102 and the vertical tube 104. A base horizontal protective pad 46 connects to said base horizontal tube 106.

OPERATION—FIGS. 1, 4, 5, 6, 7, 10

The manner of using the portable ball receiver and integrated ball supporting device is similar to other devices in present use. Namely, that a ball is struck or thrown into a receiving net used to arrest or redirect the energy of a ball. In reference to the drawings, the said support frame 20 provides a large aperture opening to receive different sized and weighted balls. The receiving net 30 being secured to said upper horizontal tube 100, and to said upper vertical tubes 102 and 120 by said cable ties 150*a–d,* becomes the pivot point for the net to extend upward and rearward to absorb energy. FIG. 2 shows the edge rope 93 woven around the net 30 and secured to the upper frame corners with cable ties (150*a–d*), and also shows the net being unattached to the vertical tube which allows the net to slide upward—allowing the loose net gathered at the bottom to aid in energy absorption.

The weight and velocity of the ball is readily absorbed by this upward and rearward net expansion. The excess of the net 30 is forced to the bottom of the frame by gravity, then folds over the ball as the net 30 returns to its pre-struck configuration. Said bottom front net flap 90 shown in FIG. 8 collects balls and acts as a block preventing said balls from escaping the net enclosure.

The integrated ball support platform in FIG. 10 absorbs energy in two distinct manners: (1) the entire platform is secured to the base horizontal tube 106 by a tee 72 and a pin 78, which allows the platform to rotate upward into the aperture of said support frame 20 when struck incorrectly; (2) a rubber attachment 52 extends beyond a inner tube for platform slide 56 enabling the robber 52 to readily absorb energy of a swinging bat.

The rubber 52 adjusts vertically by sliding over the tube 56 a machined coupler 54 held by friction inside the rubber 52 allows sliding action to occur.

Figure 9:
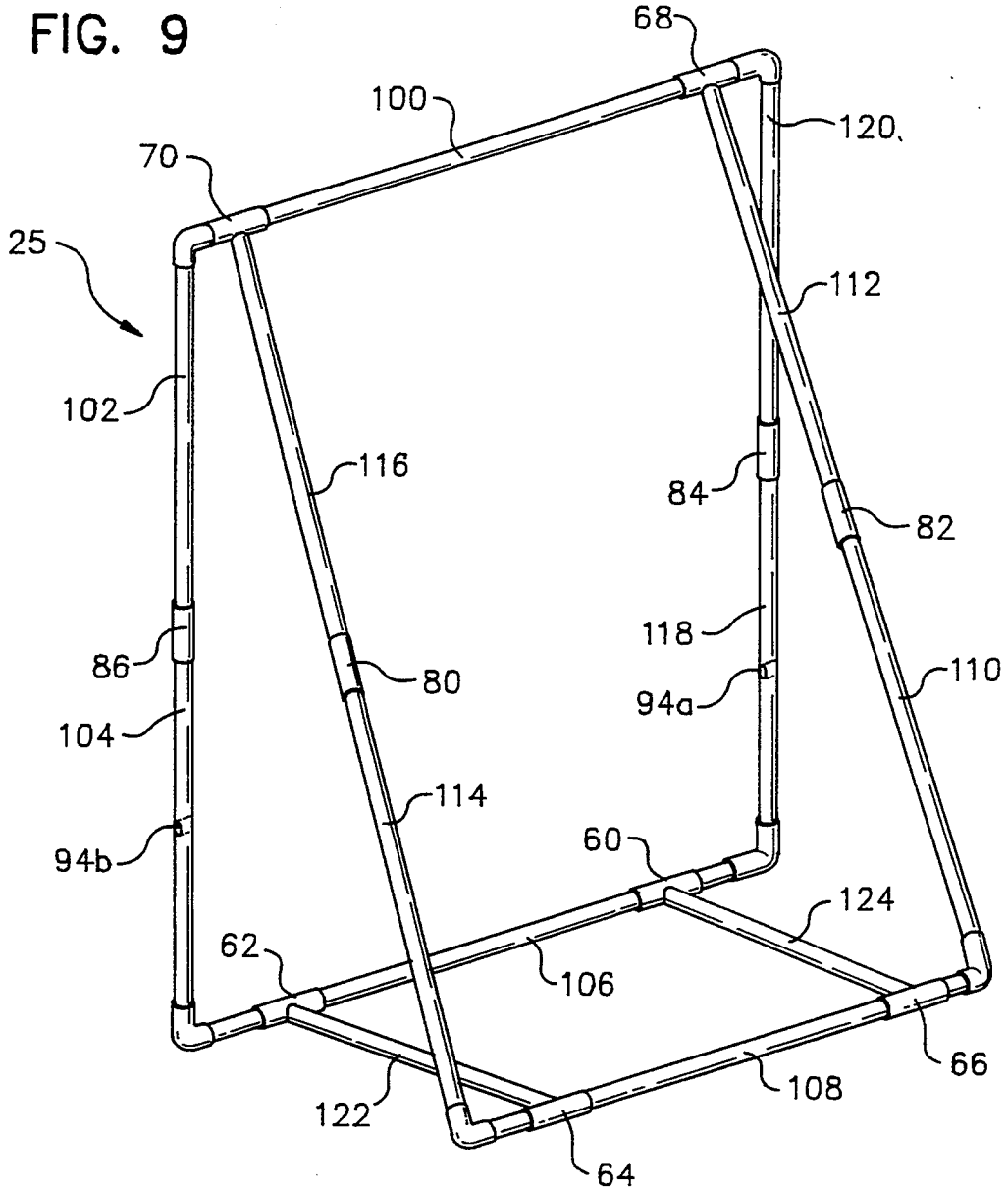
FIG. 9 shows a perspective view of the frame of the apparatus in FIG. 1 without protective padding.

Machined tee's 60, 62, and 72 rotate on the base tube 106; machined tee's 64 and 66 rotate on the rear base tube 108; machined tee's 68 and 70 rotate on the upper tube 100. FIG. 9 shows the tee's 68 and 70 are attached to a upper oblique brace tube 112 and 116 respectively, allowing the tubes 112 and 116 to rotate downward and onto the same plane and parallel to the vertical tubes 102, 104, 118, 120. The tee's 64 and 66 are attached to said rear base horizontal tube 108 so as to allow a lower oblique brace tube 114 and 110 to drop to the same plane as a rearward facing base tubes 122 and 124, the base tube 108, and the base tube 106.

The tee's 60 and 62 rotate on said base horizontal tube 106, and are further attached to said rein-ward facing base tubes 124 and 122 respectively. They allow the base tubes 108, 122, 124, and the lower oblique braces 110 and 114 to fold upward to a vertical position on the same plane and parallel to the verticals 102, 104, 118, and 120. FIG. 9 shows couplers 80, 82, 84, and 86, which when disengaged allow the frame 20 to fold at the mid-diagonal and mid-vertical sections.

Thus the reader will see that the Portable Ball Receiver with Integrated Ball Supporting Platform provides a highly reliable, portable, lightweight, and economical device. It can be easily transported by persons over the age of seven. Furthermore, the receiving net has other advantages in that it provides as an integral part of the design a stable, adjustable ball platform almost impossible to up-end; and, the receiving net provides superior performance in retaining projected balls. The above descriptions and specifications should not be construed as limiting in any way the scope of the invention. For example, the frame or net could be of different size and shape; or a net could be added to stop smaller objects. The scope of this invention should be determined not by these embodiments, but by the claims that follow.

I claim:

1. A portable ball receiving device with means to separate and rotate its segmented frame so as to facilitate portability, having attachments which may be selectively used and positioned in varying alignments comprising:

(a) a support frame having a upper horizontal tube and a base horizontal tube spaced apart from each other and connected to a first vertical tube comprised of a coupled lower tube and upper tube, and to a second vertical tube comprised of a coupled lower tube and upper tube which together define a reasonably dimensioned aperture, (b) a first oblique brace for said support frame extending from distal end of said upper horizontal tube to a rear base horizontal tube which is parallel to said base horizontal tube, and a second oblique brace for said support frame extending from opposite distal end of said upper horizontal tube and attaching to opposite distal end of said rear base horizontal, (c) a first rearward facing base tube extending perpendicular from said base horizontal tube to attach to said rear base horizontal tube, and a second rearward facing base tube extending perpendicular to said rear base horizontal tube (d) a vertically adjustable ball support platform extended forward from said base horizontal tube, (e) a target outline scented to a receiving net with means for horizontal or vertical adjustment, (f) a net attached and gravity suspended within the support frame aperture for stopping and containing projectiles traveling through said aperture with said net means operating in a rearward and upward sliding manner when dispersing projectile energy.

2. The device of claim 1 wherein the first and second vertical tubes and the first and second oblique tubes are pivotally attached and midpoint coupled with means for rotation and separation to allow the said first and second tubes and the said first and second oblique tubes to fold onto the same plane as said first and second rearward facing bases and said rear base horizontal.

* * * * *